United States Patent [19]

Scholl

[11] Patent Number: 4,589,359

[45] Date of Patent: May 20, 1986

[54] WORKPIECE RECEIVING DEVICE FOR A SEWING MACHINE, IN PARTICULAR FOR A COMPUTER-CONTROLLED AUTOMATIC SEWING DEVICE

[75] Inventor: Hans Scholl, Oerlinghausen-Lipperreihe, Fed. Rep. of Germany

[73] Assignee: Kochs Adler AG, Fed. Rep. of Germany

[21] Appl. No.: 791,788

[22] Filed: Oct. 28, 1985

[30] Foreign Application Priority Data

Nov. 28, 1984 [DE] Fed. Rep. of Germany ..... 3443314

[51] Int. Cl.[4] ..... D05B 21/00

[52] U.S. Cl. ..... 112/121.12; 112/104

[58] Field of Search ..... 112/121.12, 121.15, 112/121.11, 260, 102, 103, 113; 74/567, 568 R; 248/358 R

[56] References Cited

U.S. PATENT DOCUMENTS

| | | | |
|---|---|---|---|
| 3,172,379 | 3/1965 | Light | 112/121.12 |
| 3,869,998 | 3/1975 | Scholl | 112/121.15 |
| 4,006,698 | 2/1977 | Scholl et al. | 112/121.11 X |
| 4,312,283 | 1/1982 | Fischer et al. | 112/121.12 |
| 4,494,470 | 1/1985 | Fischer et al. | 112/121.12 |

*Primary Examiner*—H. Hampton Hunter

*Attorney, Agent, or Firm*—Laff, Whitesel, Conte & Saret

[57] ABSTRACT

A workpiece receiving device for a sewing machine, in particular for an automatic sewing device, is provided with workpiece receiving elements for clampingly receiving a workpiece at one side of a seam to be produced in the marginal area of the workpiece, the workpiece, namely a shirt collar, being provided at least with one tip. In order to also safely clamp the tip area of the workpiece for producing exact corner stitches without distortion of the workpiece, the workpiece receiving device is provided with an auxiliary workpiece clamp for clamping the workpiece tip, the auxiliary workpiece clamp being movable from an inoperative position into an operative position.

7 Claims, 8 Drawing Figures

Fig. 1
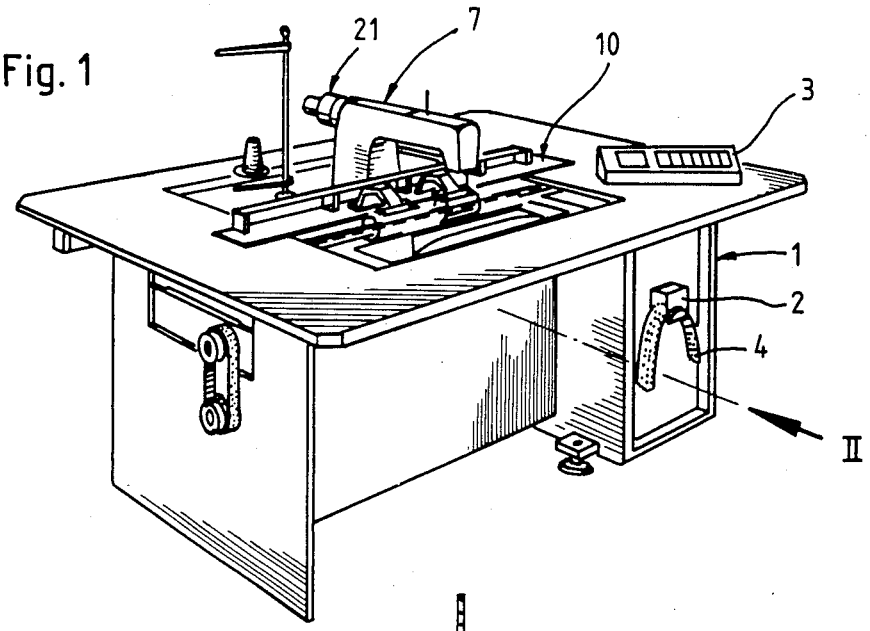
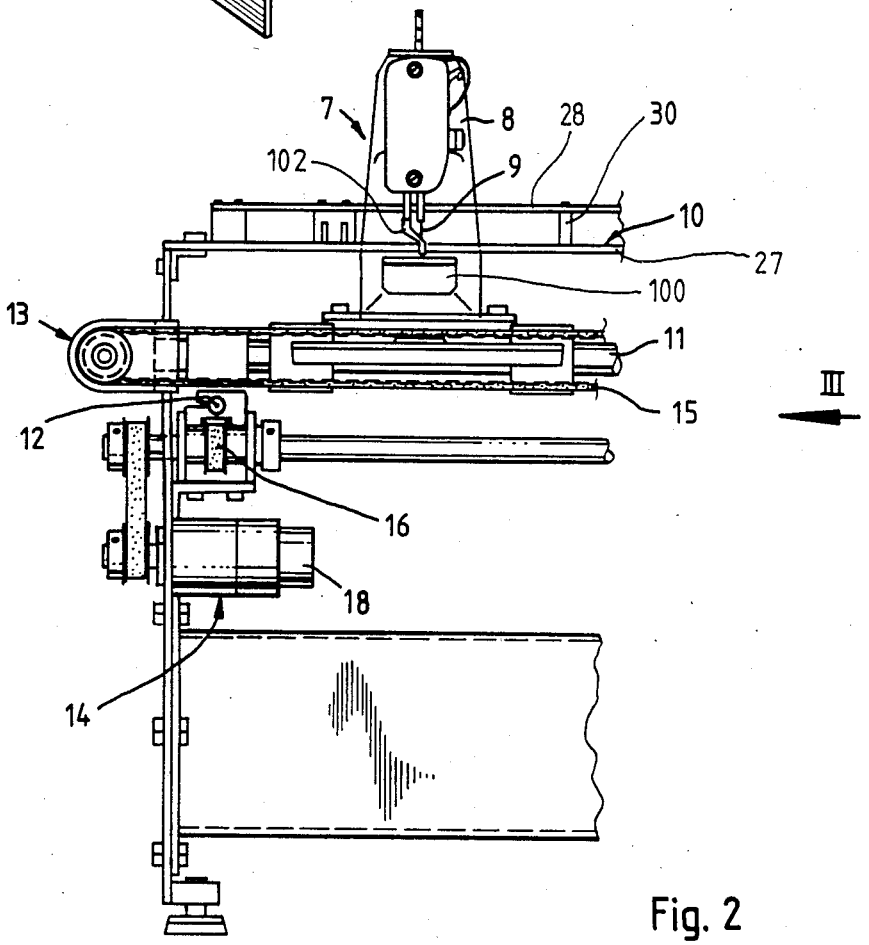
Fig. 2

Fig. 6
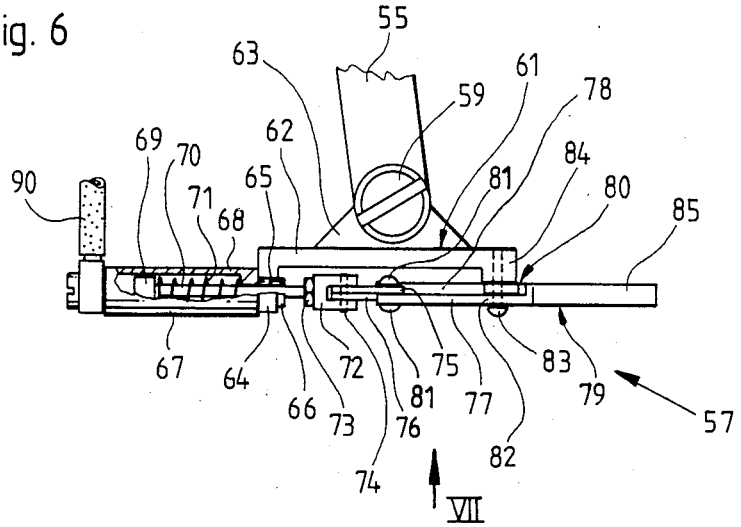
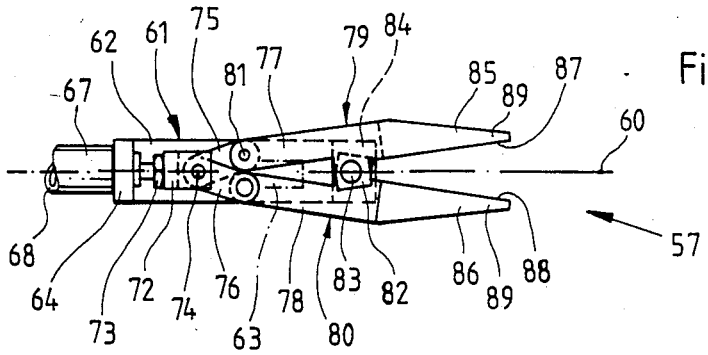
Fig. 7
Fig. 8
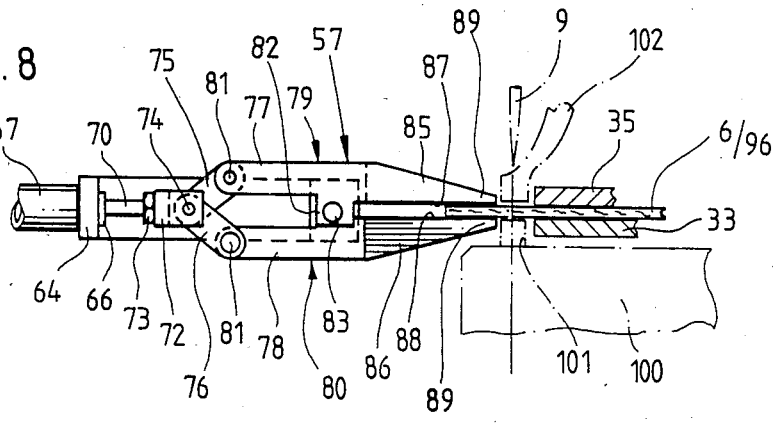

WORKPIECE RECEIVING DEVICE FOR A SEWING MACHINE, IN PARTICULAR FOR A COMPUTER-CONTROLLED AUTOMATIC SEWING DEVICE

FIELD OF THE INVENTION

The invention relates to a workpiece receiving device for a sewing machine, in particular for a computer-controlled automatic sewing device, for receiving a workpiece having at least one tip and to be provided with a seam at its marginal area, said workpiece being in particular a shirt collar, and said workpiece receiving device having receiving elements for clampingly receiving said workpiece on one side of the seam to be generated.

BACKGROUND OF THE INVENTION

In such a workpiece receiving device known from U.S. Pat. No. 4,312,283 one of the receiving elements is stationarily arranged while the other receiving element is linearly adjustable for the adaptation to different shirt collar sizes. Each of the receiving elements consists of a supporting plate and an associated clamp plate. In particular at very acute-angled collar shirts or comparable workpieces the clamping plates must be very carefully machined and profiled at the tip area so as to achieve a uniform clamp action over the total marginal area of the workpiece. Even at keeping these requirements it cannot be prevented that the collar tip will be distorted after the generation of a seam due to a distorsion of the workpiece due to the seam generation.

From U.S. Pat. No. 3,172,379 a workpiece receiving device is known wherein two plates arranged on one another receive clampingly the workpiece and are profiled with congruent slots, in which the seam extends. Thus, the workpiece is clampingly kept on both sides of the same to be generated. Due to the lability of the plates the workpiece can only be weakly clamped in the marginal area outside of the seam to be produced. As the receiving elements are necessarily of large areas, it is difficult to provide a loading device for the automatic loading and removal.

SUMMARY OF THE INVENTION

The object of the invention is to create a workpiece receiving device which is capable to safely clamp the tip areas of the workpiece.

according to the invention the workpiece receiving device is provided with at least one auxiliary workpiece clamp tiltable from an inoperative position into an operative position so as to clamp the workpiece tip. It is thus achieved that the tip areas of the workpiece are safely clamped, so that corner stitches can be precisely positioned. As the auxiliary workpiece clamps can be tilted after the sewing procedure from an operative position into an inoperative position, an unobstructed loading respectively removal of the workpiece by means of a loading device installed in front of the workpiece receiving device is rendered possible without any problems.

A modification of the auxiliary workpiece clamp with two operable tongs parts grasping the workpiece tips, a swinging-in of the auxiliary workpiece clamp is rendered possible without the risk to touch the workpiece tips at this and, possibly, to deform or bend down the tips.

An especially simple construction of the drives of the auxiliary workpiece clamp is achieved be providing a pneumatic cylinder for the drive of the tongs parts.

Furthermore, it is very advantageous to arrange the tongs parts symmetrically with respect to a central plane of symmetry which is in alignment with respect to the central plane of the clamped workpiece.

Other objects, advantages and features of the present invention will appear from the detailed description of the preferred embodiment, which will now be explained in conjunction with the accompanying drawings.

BRIEF DESCRIPTION OF THE DRAWINGS

FIG. 1 is a perspective total view of an automatic sewing device;

FIG. 2 is a partial front plan view or the automatic sewing device in the direction of arrow II in FIG. 1;

FIG. 6 is an enlarged representation of an auxiliary workpiece clamp shown in FIG. 5;

FIG. 7 is a front plan view of the auxiliary workpiece clamp in the direction of the arrow VII in FIG. 6, and FIG. 8 is a representation according to FIG. 7 showing the auxiliary workpiece clamp in operative position.

DESCRIPTION OF THE PREFERRED EMBODIMENT

Figure 3:
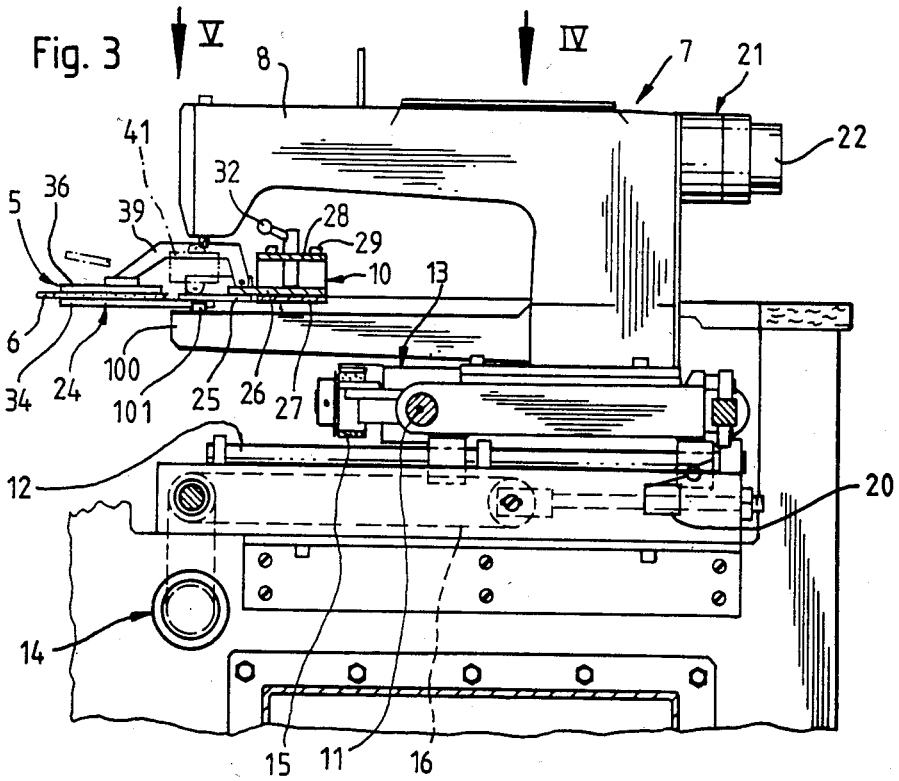
FIG. 3 is a partial side view of the automatic sewing device in the direction of arrow III in FIG. 2.

Referring more particularly to the drawings, in FIG. 1 an automatic sewing device is illustrated for producing shirt collars of different sizes, which is controlled by a computer 1 having a tape reader 2. The functions of the computer 1 are manually released by means of a panel 3. Prior to a sewing cycle, the tape reader 2 is loaded with a control tape 4, having coded information which is read into the computer 1 as soon as the command is inserted into the panel 3. Besides coded information for a workpiece receiving device 5 (FIG. 5) receiving a workpiece 6, the tape 4 carries information about significant points defining a sewing contour to be controlled. For the seam to be produced, these significant points are fed into the computer 1 as X-Y-coordinates which represent parameters for the algorithm of computation, in order to calculate the remaining points of the contour by applying linear or square interpolation. Moreover, information of special points of the contour are read into the computer 1, as for example, the corners of collar tips, so that, after reaching such significant points, the computer logic is capable to branch the program for considering the complicated control operation adjacent to these points. Furthermore, the tape 4 delivers information to the computer 1, for which, at sections of the contour, additionally offered parameters have to be considered. Among other things, such parameters define the continuous sizing for adaptation to the different manufacturing sizes. These parameters are considered by the computer 1 in the contour sections as provided by the tape 4.

Figure 5:
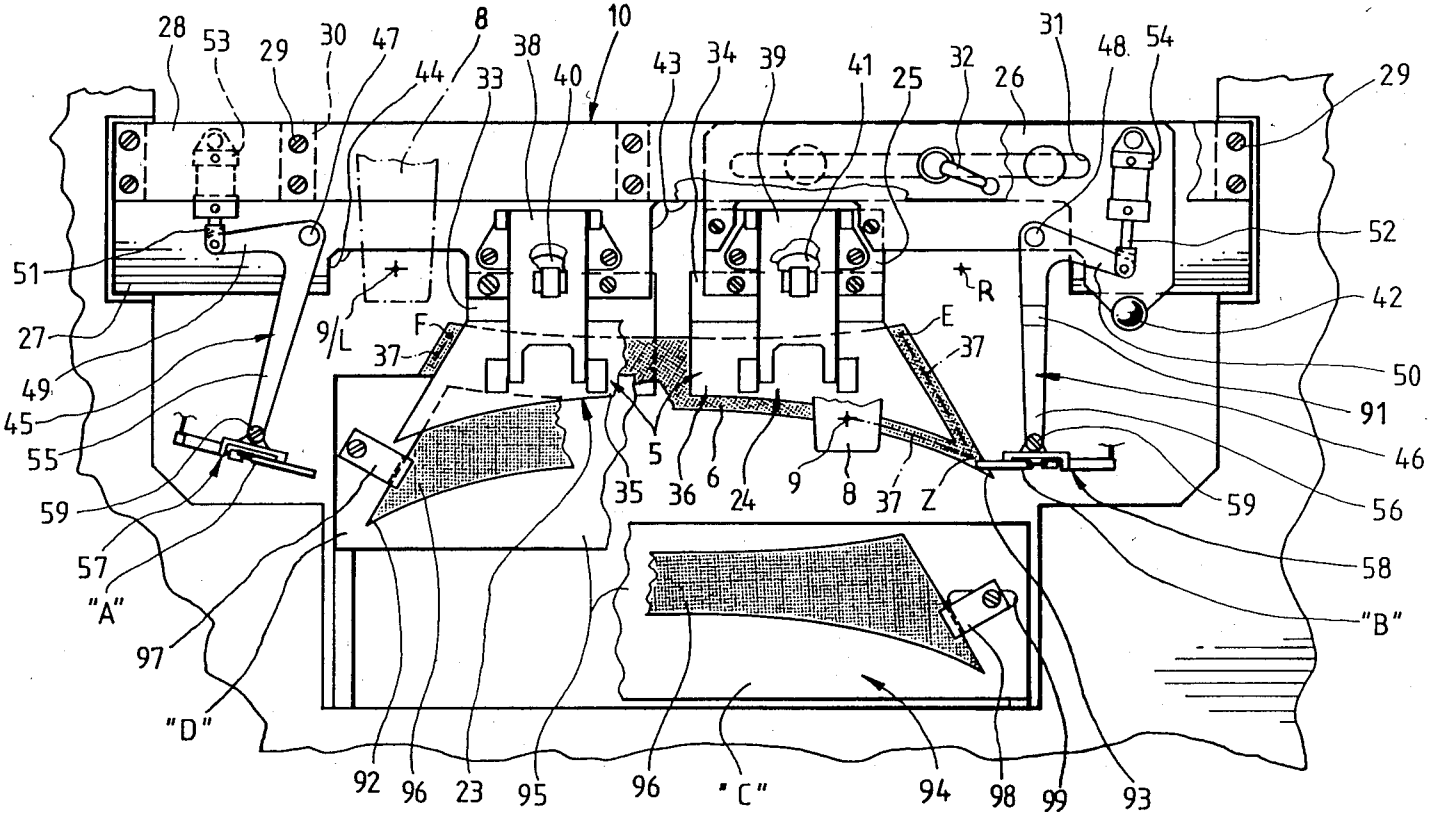
FIG. 5 is a top plan view of the workpiece receiving device in the direction of the arrow V in FIG. 3, on an enlarged scale.

The automatic sewing device illustrated in FIG. 1 is provided with a workpiece receiving device 5 as illustrated in FIG. 5 for the purpose of manufacturing shirt collars of different sizes. Shirt collars of different sizes differ from one another, as the middle part beside otherwise equal dimensions is extended such that the desired collar size is achieved.

Figure 4:
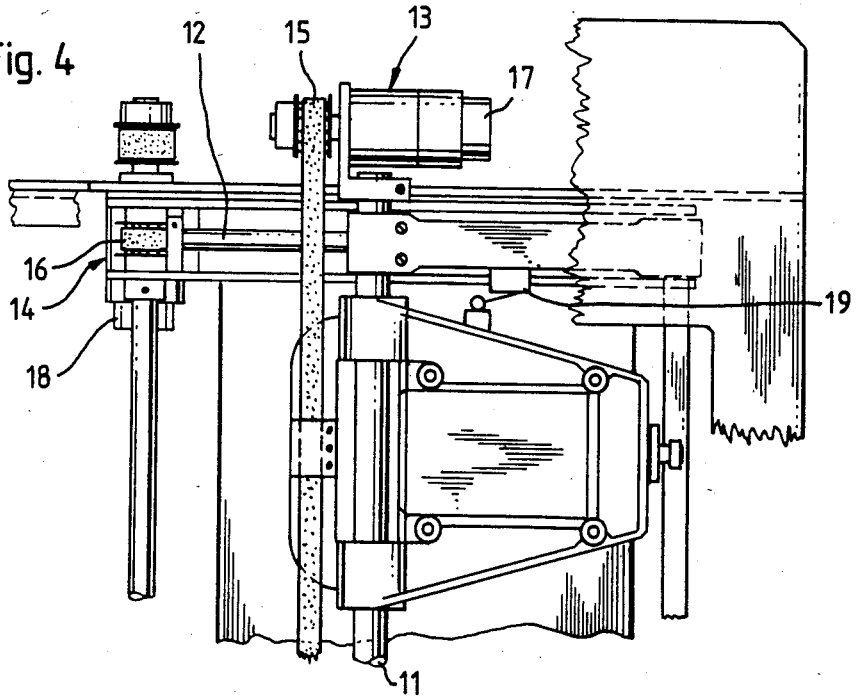
FIG. 4 is a partial top plan view of the sewing device in the direction of arrow IV in FIG. 3, without sewing head, however.

According to FIGS. 2 and 3 a sewing head 7 as a part of a sewing machine 8 is provided with a needle 9. The workpiece receiving device 5 is secured to a stationary bracket 10. As shown in FIGS. 2, 3 and 4, the sewing head 8 is movably arranged on two guide bars 11 (X-direction) and 12 (Y-direction) which are horizontal and perpendicular to each other, and installed so as to allow the sewing machine 8 to move in a horizontal plate. The sewing head 8 is drivingly connected by timing belts 15, 16 to servo motors 13, 14.

The servo motors 13, 14 are equipped with encoders 17, 18 (FIGS. 2 and 4), which indicate the position of the needle 9 relative to the stationary workpiece receiving device 5 in X- and Y-direction. Prior to operation, the encoders 17, 18 are calibrated in conjunction with the switches 19, 20. The computer 1 controls the servo motors 13, 14 in such a manner that the position of the sewing machine 8 corresponds to a given position of the computer 1 when the needle 9 enters the workpiece 6.

In order to inform the computer 1 about the vertical position of the needle 9, the sewing machine 8 is provided with an encoder 22 associated to the sewing head drive 21 (FIG. 3), which puts out a zero pulse per one needle stroke and informs the computer 1 at any time about the position of the needle 9. The sewing head drive 21 as well as the servo motors 13, 14 are controlled by the computer 1, so that, when sewing difficult contours (e.g. collar tips), the needle 9 only pierces points of the desired sewing contour and not such points at such critical points of the contour which may be produced by the overriding sewing machine 8 moved in X- and Y-direction. As so far described the construction of the automatic sewing device is known from U.S. Pat. No. 4,312,283.

As illustrated in FIG. 5 the workpiece receiving device 5 consists of two parts, a stationary workpiece receiving element 23 secured to the stationary bracket 10, and an adjustable workpiece receiving element 24 connected via an intermediate plate 25 to a slide plate 26. The stationary bracket 10 is provided with a lower plate 27 and an upper plate 28, which are connected parallelly to each other and spaced from one another by means of screws 29 and spacers 30. The slide plate 26 is provided with a longhole-profiled guide 31 and displaceably arranged on the lower plate 27 and clamped thereto by a clamping lever 32 passing through the guide 31 so that the slide plate 26 is stationarily but releasably blocked with respect to the stationary bracket 10.

The stationary workpiece receiving element 23 as well as the adjustable workpiece receiving element 24 each are provided with supporting plates 33, 34 and clamping plates 35, 36, the outer edges of which are coincidently profiled according to the contour of a seam 37 to be produced. The function of the workpiece receiving elements 23, 24 is to hold the workpiece 6, at which the space between the workpiece receiving elements 23, 24 may be overbridged by a thin sheet secured to the supporting plate 33 of the stationary workpiece receiving element 23. The sheet is not illustrated in the drawings. Thus, the workpiece 6 is only clamped by the workpiece receiving element 23 resp. 24 at one side of the seam 37 to be produced.

As obvious from FIGS. 3 and 5, the clamping plates 35, 36 are fastened to levers 38, 39. The lever 38 is swingably supported to the lower plate 27 of the stationary bracket 10 and the lever 39 is swingably supported to the intermediate plate 25, which is displaceable together with the slide plate 26. Both clamping plates 35, 36 are displaceable by pneumatic cylinders 40, 41, which on one hand are hinged to the levers 38, 39 and on the other hand to the lower plate 27 resp. the intermediate plate 25.

Upon adjustment of the slide plate 26 the adjustable workpiece receiving element 24 together with the lever 39 and the associated pneumatic cylinder 41 is displaced. For displacement of the slide plate 26 a freely accessible handle 42 is provided in front of the upper plate 28. In order to facilitate displacement of the slide plate 26 and the parts fastened thereto a recess 43 is arranged in the front surface of the lower plate 27 turned to the clamping plates 35, 36 for displaceably receiving the intermediate plate 25. A further recess 44 of the lower plate 27 is arranged at the side of the lever 38 turned away from the adjustable workpiece receiving element 24.

In the area outside of the clamping plates 35, 36 at the lower plate 27 resp. the slide plate 26, two angle levers 45, 46 are arranged symmetrically to each other which are swingable about vertical axes 47, 48. The free ends of the short levers 49, 50 of the angle levers 45, 46 are hinged to the free ends of piston rods 51, 52 of double acting pneumatic cylinders 53, 54. The pneumatic cylinders 53, 54 are hinged to the lower plate 27 resp. the slide plate 26. To each of the other long levers 55, 56 is fastened an auxiliary workpiece clamp 57, 58 by means of screws 59. The auxiliary workpiece clamps 57, 58 are tiltable by means of the angle levers 45, 46 in such a manner that their symmetrical central plane 60 is identical with the plane extending parallelly through the middle of the workpiece 6.

The construction of the auxiliary workpiece clamps 57, 58 is obvious from FIGS. 6–8. As the auxiliary workpiece clamps 57, 58 are mirror-symmetrically constracted, only the auxiliary workpiece clamp 57 is hereinafter described. The auxiliary workpiece clamp 57 is provided with a C-shaped carrier 61, the web 62 of which is formed with a bearing eye 63 through which passes a screw 59 in order to be screwed into the end of the long lever 55. A shank 64 of the carrier 61 is formed with a bore 65 into which is screwed the fastening part 66 of a single acting pneumatic cylinder 67. The pneumatic cylinder 67 has a cylindrical housing 68, in which is displaceably arranged a piston 69 with a piston rod 70. The latter is guided outwards through the fastening part 66. About the piston rod 70 a compression spring 71 is arranged tending to move the piston 69 together with the piston rod 70 into their retracted position in the housing 68. To the free end of the piston rod 70 guided through the fastening part 66 is screwed a U-shaped toggle lever 72, which is secured by a nut 73. The shanks of the toggle lever 72 are provided with flushing bores, into which is pressed a pin 74 for swingable supporting two adjoining butt straps 75, 76. To the free ends of the butt straps 75, 76 the ends 77, 78 of two double-armed levers 79, 80 are hinged by means of rivets 83. In their longitudinal center the two double-armed levers 79, 80 are provided with a common swivel bearing 82 wherein is received a rivet 83 defined as a swivel axis for swingably securing the double-armed levers 79, 80 to the other shank 84 of the carrier 61. With their surfaces turned to each other, tongs parts 85, 86 of the double-armed levers 79, 80 turned away from the butt straps 75, 76 are provided with clamping surfaces 87, 88. In the closed position of the auxiliary workpiece clamp 57, as illustrated in FIG. 8, the clamping surfaces 87, 88 extend parallelly to each other with a distance therebetween having approximately the thickness of the workpiece 6. the tongs parts 85, 86 each narrow to a blunt tip 89.

The pneumatic cylinder 67 is supplied by compressed air via a hose 90. In the long lever 56 of the angle lever 46 an offset 91 is formed so that the auxiliary workpiece clamp 58 moves in the same plane as the auxiliary workpiece clamp 57 as already described above.

By corresponding air pressurization of the pneumatic cylinders 53, 54 the auxiliary workpiece clamps 57, 58 are displaced between two end positions, i.e. an inoperative position A (see auxiliary workpiece clamp 57 in FIG. 5) and an operative position B (see auxiliary workpiece clamp 58 in FIG. 5). When the auxiliary workpiece clamps 57, 58 are in their inoperative position A, an unobstructed loading of the workpiece receiving device 5 with a workpiece 6 respectively the removal of the workpiece 6 out of the workpiece receiving device 5 is possible. In the operative position B clamping of a workpiece tip 92 resp. 93 is possible by means of the two auxiliary workpiece clamps 57 resp. 58. Displacement of the two auxiliary workpiece clamps 57, 58 is performed simultaneously, i.e. both clamps 57, 58 are positioned either in the inoperative position A or in the operative position B. As obvious from FIG. 5, the automatic sewing device is provided with a loading device 94 having a displaceable plate 95, which is movable to and fro between two end positions, i.e. a loading position C and a not illustrated transferring position. In the loading device 94 is positioned a not sewn workpiece 96 which is held on the plate 95 by means of the positioning/clamping elements 97, 98. In FIG. 5 the plate 95 is illustrated in an intermediate position D. In the not-illustrated transferring position the not sewn workpiece 96 and the already sewn workpiece 6 are positioned coincidently one above the other. Thus, the plate 95 is so arranged with respect to the sewing plane as to be positioned in the transferring position above the already sewn workpiece 6. The suspension of the plate 95 additionally renders possible a slight lowering upon the workpiece 6 when the workpiece receiving elements 23, 24 receive a not sewn workpiece 96. With respect to the workpiece the lower surface of the plate 95 has a higher coefficient of friction that the upper surface so that when the plate 95 is moved back from the transferring position into the loading position C the sewn workpiece 6 is drawn out of the workpiece receiving device 5 and subsequently stored in a not illustrated magazine arranged below the loading device 94. The positioning/clamping element 98 associated to the adjustable workpiece receiving element 24, is adjustably secured in an oblong hole 99 of the plate 95. Both elements 97, 98 are formed so as to prevent a collision with the clamping plates 35, 36 while the plate 95 is moved.

The pneumatic cylinders 40, 41, 53, 54 and 67 are connected via compressed air hoses, e.g. the hose 90, to compressed air valves, e.g. solenoid valves, the electrical actuation of which is controlled by the computer 1 according to the sequence of operations.

In the hereinafter described operation it is assumed that the sewing machine 8 together with its needle 9 is positioned in a right end position R (FIG. 5), that the clamping plates 35, 36 are located in a dot-dashed position according to FIG. 3, that there is no workpiece 6 in the workpiece receiving element 23, that the auxiliary workpiece clamps 57, 58 are positioned in their inoperative positions A and that the plate 95 is positioned in the loading position C.

After the operator has positioned a not sewn workpiece 96 on the plate 95, the workpiece 96 is clamped by means of the positioning/clamping elements 97, 98. Subsequently, the plate 95 with the workpiece 96 clamped thereon is inserted into the opened workpiece receiving elements 23, 24. As soon as the plate 95 has reached the transferring position, the computer 1 causes the lowering of the clamping plates 35, 36 by correspondingly pressurizing the pneumatic cylinders 40, 41. Simultaneously, the positioning/clamping elements 97, 98 are opened so that the not sewn workpiece 96 is released. Then the plate 95 is moved back into the loading position C. As the clamping plates 35, 36 rest upon the workpiece 96, the latter remains in the workpiece receiving elements 23, 24, wherein it is clamped between the clamping plates 35, 36 and the associated supporting plates 33, 34. Subsequently, the computer 1 causes the sewing machine 8 at inoperative sewing head drive 21 to be moved by means of the servo motors 13, 14 in the X- and Y-direction in such a manner, that the needle 9 is positioned above the seam starting point E. From this starting point E sewing of the seam 37 is started, at which the sewing machine 8 is completely controlled by the computer 1. In order to perform this sewing operation the computer 1 is informed about the actual position of the needle 9 in X- and Y-direction by the encoders 17, 18 and the encoder 22. As soon as the sewing machine 8 has carried out some stitches from the seam starting point E, the computer 1 gives order to displace the auxiliary workpiece clamps 57, 58 out of their inoperative positions A into their operative positions B. As soon as the operative positions B are reached, the computer 1 causes the pneumatic cylinders 67 to be pressurized so that the tongs parts 85, 86 of each auxiliary workpiece clamp 57, 58 are closed. At this, the tongs parts 85, 86 seize the corresponding workpiece tip 92 as obvious from FIG. 8. This kind of clamping the workpiece tips 92 prevents the workpiece from being distorted when the corner points Z are produced. Consequently, the strain in the workpiece, especially at the workpiece tips 92, 93 occuring during the stitch formation is absorbed by the auxiliary workpiece clamps 57, 58. Of course, the tongs parts 85, 86 seize the workpiece tips 92, 93 with a sufficient distance with respect to the seam 37 to be produced and especially with an adequate distance from the corner point Z to be produced. As illustrated in FIG. 8, the tubular stud 101 arranged at the lower arm 100 of the sewing machine 8, and the presser foot 102 surrounding the needle 9, pass the tips 89 of the tongs parts 85, 86 without any trouble.

Finally, the continuing sewing operation produces a further corner point Z in the area of a further workpiece tip 92 and a further seam 37 terminating at a seam end point F. Here a thread cutting cycle is accomplished, which is controlled by the computer 1. Subsequently, the computer 1 moves the sewing machine 8 without sewing into an end position L—shown in FIG. 5 on the left side—wherein the position of the sewing machine 8 is illustrated by dot-dashed lines. After reaching the end position L the computer 1 causes the releasing of the workpiece tips 92, 93 by depressurizing the pneumatic cylinders 67 of the auxiliary workpiece clamps 57, 58, the returning of the auxiliary workpiece clamps 57, 58 from their operative positions B into their inoperative positions A and finally the lifting of the clamping plates 35, 36 by pressurizing the pneumatic cylinders 40, 41 in reversed order.

At this, a not sewn workpiece 96 positioned by the operator on the plate 95 during the sewing operation may be inserted into the opened workpiece receiving elements 23, 24 in the already described manner, and the sewn workpiece 6 may be removed and stored in the magazine. Removal of the sewn workpiece 6 is in such a manner that it is taken along due to the already mentioned high coefficient of friction with respect to the lower surface of the plate 95. This kind of loading and removal is known from U.S. Pat. No. 3,869,998.

Usually the manufacture of shirt collars is such that the workpiece tips 92, 93 form the collar tips. These workpiece tips must not be tips in the mathematical sense, they also may have slight roundings up to a radius of approximately 6 mm. Also in this case the auxiliary workpiece clamps 57, 58 according to this invention may be advantageously applied.

For the production of shirt collars of different sizes the adjustable workpiece receiving element 24 together with the associated auxiliary workpiece clamp 58 may be displaced by means of the handle 42 after releasing of the clamping lever 32. Such a displacement requires a re-adjustment of the positioning/clamping element 98 of the loading device 94. After the new size adjustment the adjustable workpiece receiving element 24 is again locked by means of the clamping lever 32. This kind of size adjustment is known from U.S. Pat. No. 4,312,283.

As the workpiece tips 92, 93 are held by the auxiliary workpiece clamps 57, 58 the associated tips of the supporting plates 33 res. 34 and the clamping plates 35 resp. 36 may be rounded as a sufficient fixing of the workpiece 96 resp. 6 is ensured in the area of the workpiece tips 92, 93.

I claim:

1. A workpiece receiving device for a sewing machine, in particular for a computer-controlled automatic sewing device, for receiving a workpiece having at least one tip and to be provided with a seam at its marginal area, said workpiece being in particular a shirt collar, and said workpiece receiving device having receiving elements for clampingly receiving said workpiece on one side of the seam to be generated, wherein the workpiece receiving device is provided with at least one auxillary workpiece clamp tiltable from an inoperative position into an operative position so as to clamp the workpiece tip.

2. A workpiece receiving device according to claim 1, wherein said auxiliary workpiece clamp is proficed with two drivable tongs parts grasping the workpiece tip.

3. A workpiece receiving device according to claim 2, wherein a pneumatic cylinder is provided for driving said tongs parts.

4. A workpiece receiving device according to claim 2, wherein the tongs parts are symmetrically arranged with respect to a central plane of symmetry which is in alignment with respect to said clamped workpiece.

5. A workpiece receiving device according to claim 1, wherein a tiltably drivable lever is provided for tilting said auxiliary workpiece clamp.

6. A workpiece receiving device according to claim 5, wherein said auxiliary workpiece clamp is adjustably connected with said lever.

7. A workpiece receiving device according to claim 1 having two receiving elements one of which receiving elements is adjustable relative to the other receiving element, wherein an auxiliary workpiece clamp is adjustably associated to said adjustable receiving element.

* * * * *